US005353969A

United States Patent [19]

Balderrama

[11] Patent Number: 5,353,969

[45] Date of Patent: Oct. 11, 1994

[54] INVERTIBLE PUMP SPRAYER HAVING SPIRAL VENT PATH

[75] Inventor: Mark A. Balderrama, Colton, Calif.

[73] Assignee: Calmar Inc., City of Industry, Calif.

[21] Appl. No.: 135,438

[22] Filed: Oct. 13, 1993

[51] Int. Cl.[5] ..... B67D 5/42

[52] U.S. Cl. ..... 222/321; 222/402.19; 222/375

[58] Field of Search ..... 222/321, 402.19, 372, 222/375, 376, 383, 385; 239/333; 417/547, 550, 511, 512, 566

[56] References Cited

U.S. PATENT DOCUMENTS

| | | | |
|---|---|---|---|
| 3,520,452 | 7/1970 | Malone | 222/321 |
| 4,154,374 | 5/1979 | Kirk . | |
| 4,168,788 | 9/1979 | Quinn | 222/383 |
| 4,277,001 | 7/1981 | Nozawa . | |
| 4,435,135 | 3/1984 | Knickerbocker | 222/321 X |
| 4,694,976 | 9/1987 | Schuetz | 222/321 X |
| 4,775,079 | 10/1988 | Grothoff . | |
| 4,936,492 | 6/1990 | Amiel et al. | 222/321 X |
| 4,938,392 | 7/1990 | Su | 222/375 X |
| 4,986,453 | 1/1991 | Lina . | |
| 4,991,746 | 2/1991 | Schultz | 222/321 |
| 5,092,495 | 3/1992 | Andre | 222/321 X |
| 5,222,636 | 6/1993 | Meuresch | 222/321 |

*Primary Examiner*—Andres Kashnikow
*Assistant Examiner*—Kenneth DeRosa
*Attorney, Agent, or Firm*—Watson, Cole, Grindle & Watson

[57] ABSTRACT

A liquid dispensing pump capable of inverted spray has a container vent including a spiral vent groove of a length restricting the free flow of liquid therethrough to avoid leakage, and being sized so that while dispensing in the inverted position the rate of liquid discharge from the container is greater than the flow of air through the vent groove which thereby creates a vacuum in the container and effects a suck-back of air through the vent into the container for venting.

6 Claims, 1 Drawing Sheet

10
18
19
37
20
17
16
42
36
38
24
46
43
23
21
15
22
13
25
12
11
34
35
26
14
29
31
27
32
33
28

16
35
52
53
51
49
38
46
13

42
52
51
53
41
39
49
43
38
47
13
46
48

26
46
15
11
54

16
45
43
44
15
38

INVERTIBLE PUMP SPRAYER HAVING SPIRAL VENT PATH

BACKGROUND OF THE INVENTION

This invention relates generally to a manually actuated pump sprayer adapted for dispensing liquid from a container in both upright and inverted modes. More particularly, the pump sprayer has a container vent for equalizing the pressures within and outside the container when the pump is in operation to thereby prevent hydraulic lock of the pump piston, the vent being in the form of a spiral vent groove.

In the prior art pump sprayers of the type shown in the U.S. Pat. Nos. 4,051,983, 4,154,374 and 4,986,453 the closure cap is directly or indirectly coupled to the pump cylinder at its upper end for supporting the pump body within the interior of the container to which the pump body is mounted. A vent path is defined from inside the container via the top of the pump cylinder and between the closure cap and the piston stem to the ambient for venting the container during the piston downstroke and upstroke movements for replacing the liquid dispensed from the container with air to prevent container collapse during pumping and hydraulic piston lock. A depending collar on the closure cap is seated against an upper end of the pump piston at the end of the piston upstroke movement for sealing the vent path closed from the atmosphere to thereby avoid leakage through the vent path during shipping and storage of the pump assembly.

These sprayers are not readily adapted for operation in an inverted or steeply slanted position, even with the provision of an inverted adaptor of the type disclosed in U.S. Pat. Nos. 4,277,001 or 4,775,079, since the container vent which opens during the upstroke and downstroke of movements of the piston during pumping allows for leakage of liquid product therethrough in that the vent path is not designed to restrict the passage of liquid nor is the vent path designed to control the rate of venting relative to product displacement during spraying.

U.S. Pat. No. 4,277,001 discloses an upright/inverted sprayer having spaced vent ports located in the pump cylinder wall controlled by upper and lower skirts on the piston. However, leakage of product through the open container vent port or ports during pumping is not positively avoided since the valved vent port arrangement is incapable of controlling the rate of venting in relation to the product being dispensed during pumping. Besides, an additional vent skirt on the piston is required which adds to the cost and complexity of the pump assembly.

U.S. Pat. No. 4,775,079 discloses an upright/inverted pump sprayer having an elongated vertical vent path to avoid the ingestion of any air bubbles into the pump chamber during an inverted spray mode. However, such an elongated vent path requires a special tube or modified design of the pump assembly which only adds to the cost and complexity of the unit. Besides, the rate of venting is not readily controlled by such a design so that leakage through the open vent path could occur.

SUMMARY OF THE INVENTION

It is therefore an object of the present invention to provide an invertible pump sprayer having a container vent of simple and economical construction, easy to mold and requiring no additional components yet highly effective in venting the container during upright and inverted spray without leakage of liquid product through the open vent path.

More particularly, the container vent according to the invention extends between the interior of the closure cap and the ambient air along a path between the closure cap and the pump cylinder and further between the closure cap and the piston stem. The vent path comprises a spiral vent groove formed between a wall of the closure cap and a confronting pump cylinder wall for restricting the free flow of liquid therethrough to avoid leakage while dispensing in the inverted position. The spiral vent groove is sized so that while dispensing in the inverted position the rate of liquid discharge from the container during pumping is greater than the flow of air through the vent groove such that a slight vacuum is created in the container whereby air is sucked into the container through the vent path during the pumping operation. The spiral vent groove thus controls the rate of venting in a simple yet highly efficient manner.

Other objects, advantages and novel features of the invention will become more apparent from the following detailed description of the invention when taken in conjunction with the accompanying drawings.

DETAILED DESCRIPTION OF THE INVENTION

Figure 1:
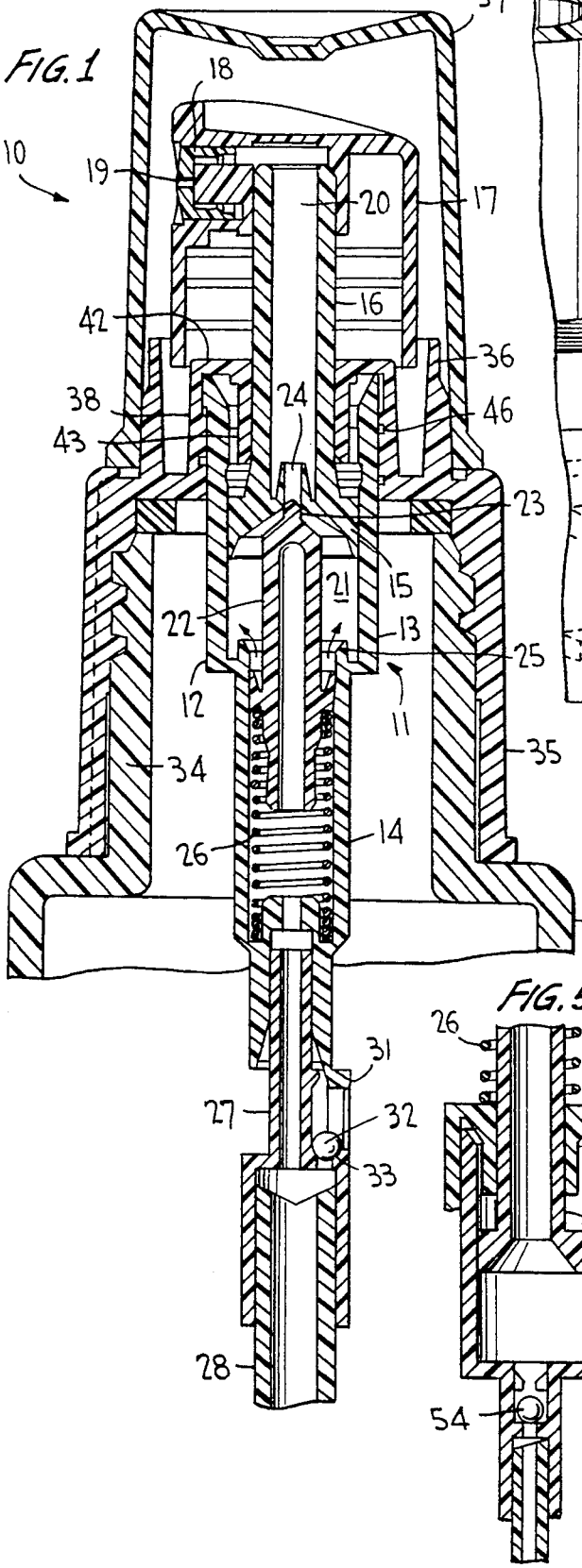
FIG. 1 is a vertical sectional view of an invertible pump sprayer including the container vent according to the invention.

Turning now to the drawings wherein like reference characters refer to like and corresponding parts throughout the several views, the invertible pump sprayer of the invention is generally designated 10 in FIG. 1 and is similar to the precompression pump sprayer disclosed in U.S. Pat. No. 4,051,983, commonly owned herewith. The entirety of the disclosure thereof is specifically incorporated herein by reference.

The pump sprayer includes a pump body generally designated 11 which includes a pump cylinder 12 having an enlarged upper diameter 13 and a smaller lower diameter 14. A pump piston 15 having a hollow piston stem 16 is mounted for reciprocation in larger diameter section 13 of the pump cylinder. A plunger head 17 is mounted on the upper end of the piston stem and contains a discharge plug 18 having a discharge orifice 19. The hollow piston stem and a communicating passage in the plunger head define a discharge passage 20 leading to the discharge orifice.

The piston and cylinder define a variable volume pump chamber 21, and a valve member 22 within the pump chamber has a pintle valve 23 at its upper end seated against opening 24 of the hollow piston for controlling the discharge. The valve member has a lower seal 25 arranged for sliding reciprocation within lower diameter section 14 of the pump chamber, the valve member being biased upwardly by the provision of a coil return spring 26 within section 14 of the cylinder.

An inverted adaptor 27 is mounted within and extends from the lower end of the pump cylinder, and supports a dip tube 28 which extends into container 29 on which the pump body is mounted. The adaptor, which may be of the type disclosed in FIG. 1 of U.S. Pat. No. 4,775,079, has a pair of spaced fingers 31 (only one shown) surrounding a ball check valve 32 normally seated against a ported conical valve seat 33. When the ball valve is unseated during inverted spray, as will be described in more detail hereinafter, liquid product inlets between the spaced fingers and through the open port into the hollow stem of the adaptor to charge pump chamber 21.

The pump body is mounted on neck 34 of container 29 by a closure cap 35 having internal threads engaging the external threads of the container neck. The closure cap has an upstanding annular skirt 36 on which an overcap 37 may be mounted during storage and shipping positions. The cap further has an upstanding annular wall 38 with an annular groove 39 (FIG. 3) for the reception of an enlarged annular section 41 at the upper end of the pump cylinder. The pump body is thereby coupled to the closure cap for being mounted in place within the container neck.

The closure cap has a central domed portion 42 connected to wall 38, and has a collar 43 extending downwardly therefrom and defining a central opening through which the piston stem extends.

Figure 4:
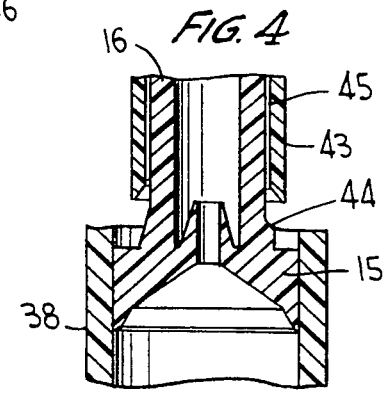
FIG. 4 is a vertical sectional view showing a part of the pump piston movable within the pump cylinder away from the container vent valve formed on the closure cap.

The piston has an enlarged annular section 44 (FIG. 4) forming a valve seat, the lower end of collar 43 bearing against the valve seat in the non-use shipping and storing positions of the pump and at the end of the upstroke movement of the piston. Collar 43 and the piston stem are sized as to present a small annular gap 45 therebetween for opening the container vent to atmosphere during the upstroke and downstroke movements of the piston.

In accordance with the invention, the container vent path includes a spiral vent groove 46 which may be formed in inner surface 47 of wall 38. Otherwise, the spiral groove could be formed in outer surface 48 of upper diameter section 13 of the pump cylinder, within the scope of the invention.

The spiral vent groove has at least one complete turn (although two spiral turns are shown) opening at its lower end within the interior of the closure cap, and opening at its opposite end into an annular gap 49 (FIGS. 2 and 3) which may be formed between enlarged section 41 and annular groove 39 during assembly.

Figure 2:
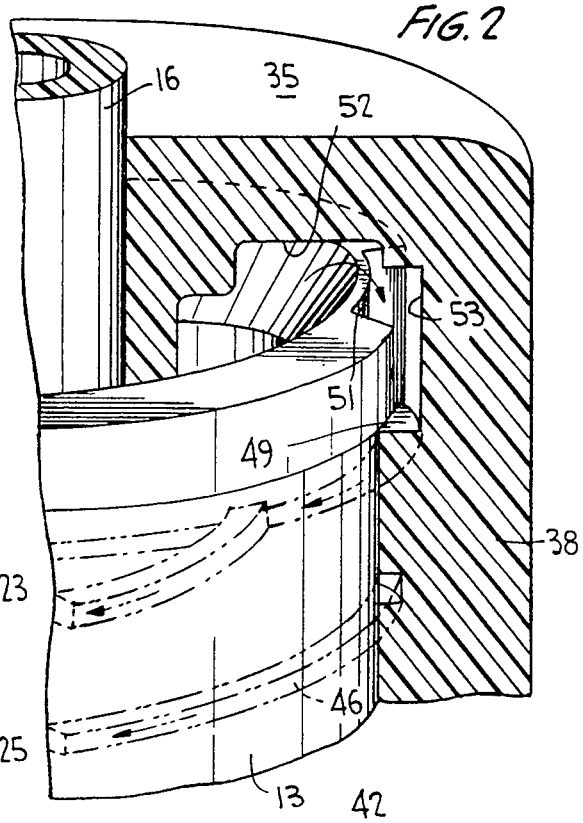
FIG. 2 is a perspective view, at an enlarged scale, showing part of the vent path of the invention including a part of the spiral vent groove.
Figure 3:
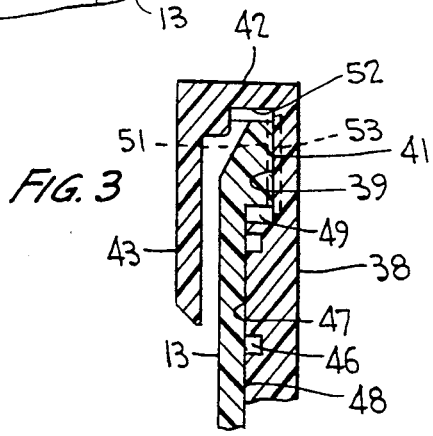
FIG. 3 is a vertical sectional view, at an enlarged scale, of a part of the closure cap and pump cylinder illustrating the FIG. 1 vent path in greater detail.

With further reference to FIGS. 2 and 3, a vertical groove 51 is formed in enlarged section 41 extending from gap 49 to an undercut 52 formed in the underside of domed portion 42. And, another vertical groove 53 facing groove 51 may be formed in wall 38.

In operation, the pre-compression pump sprayer operates in a known manner in both upright and inverted positions. With overcap 37 removed, and with pump chamber 21 primed with liquid product, finger pressure applied to plunger 17 lowers the piston compressing the liquid in the pump chamber until the liquid pressure exceeds the return force of spring 26 whereupon valve 22 moves downwardly at a faster rate compared to that of the piston to thereby open the discharge. Upon release of the applied finger pressure, the piston returns toward its FIG. 1 position during its upstroke movement thereby enlarging the volume of the pump chamber which creates a reduced pressure overtaken by the return spring causing the valve member to reseat to close the discharge and return upwardly with the piston until its lower seal 25 slightly disengages from the bore of small diameter section 14 to thereby admit product into the pump chamber from the container through dip tube 28 and adaptor 27.

In the inverted mode, ball check valve 32 falls away from its valve seat 33 under gravity such that liquid surrounding the adaptor is suctioned only through the adaptor and into the pump chamber at or near the end of the upstroke of valve member 22.

Figure 5:
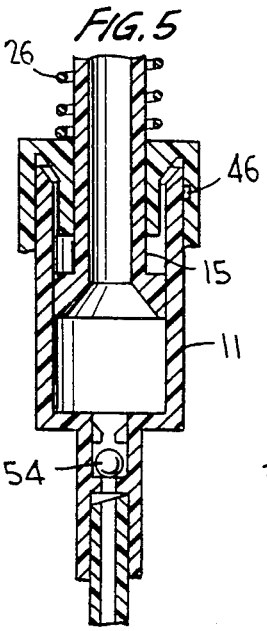
FIG. 5 is a vertical sectional view showing part of a pump assembly of an alternative pump structure.

It should be pointed out that the pre-compression pump sprayer which incorporates the invention may alternatively have a multi-piece valve member with an inlet ball check valve as in U.S. Pat. No. 4,051,983, without departing from the invention. Likewise, the pump sprayer may alternatively be of the throttling type shown in FIG. 5 as having an inlet ball check valve 54 at the throat of the pump cylinder and a separate discharge valve (not shown) of the well known type, without departing from the invention.

The container vent of the invention operates essentially the same whether spraying in an upright or an inverted position, although the operation will be described for inverted spray as it is the condition during which leakage tends to occur.

During each pressure stroke of the piston, product is displaced from the container at a given rate and must be replaced by air to avoid container collapse and to prevent hydraulic lock of the piston which would inhibit its continued operation.

During the piston downstroke and upstroke movements, its enlarged annular section 44 is shifted away from the lower end of collar 43 to thereby open the vent path permitting air to flow from atmosphere through gap 45 (FIG. 4) and following the path of the arrows of FIG. 2, i.e., through vertical grooves 51, 53, gap 49 and the spiral vent groove to the inside of the closure cap and into the liquid product which now fills the inside of the closure cap in the inverted position. The length of the vent groove and its spiral path effectively prevent leakage of liquid product therethrough. Moreover, the vent groove is sized to control the rate of venting and thus prevent any leakage of liquid product through the open vent path. The vent-to-liquid product displacement ratio is slightly negative such that air is immediately sucked into the container through the open vent path by the slightly negative pressure remaining in the container. Stated otherwise, the rate of displacement of the liquid product from the container during pumping is greater than the rate at which air can freely flow through the open vent path to replenish the dispensed volume of product. Thus, as product is dispensed the negative pressure in the container thereby created sucks air through the open vent path into the container. Since the vent path cannot pass air and product at the same time in two opposite directions the vent path is maintained free of product thereby preventing any possibility of leakage therethrough.

From the foregoing it can be seen that a simple and economical yet highly effective vent system has been provided for a manual sprayer capable of operating in an inverted position without leakage through the open vent path. The turns of the spiral vent groove can be more or fewer than illustrated although at least one complete turn should be provided to create a bent path which provides an effective air vent without possibility of leakage.

Obviously, many other modifications and variations of the present invention are made possible in the light of the above teachings. It is therefore to be understood that within the scope of the appended claims the invention may be practiced otherwise than as specifically described.

What is claimed is:

1. A liquid dispensing pump, comprising a pump body containing a pump cylinder and a pump piston having an annular depending piston skirt arranged for reciprocating sliding engagement with the wall of said cylinder during piston downstroke and upstroke movements, said piston and said cylinder together defining a pump chamber having a valve controlled inlet opening, said piston having an upstanding piston stem, a depressible discharge head mounted on said piston stem and having a discharge orifice, a discharge passage extending through said piston and said head extending from said chamber and terminating in said orifice an invertible adaptor extending from a lower end of said pump body to permit dispensing in an inverted position upon actuation of the piston, said adaptor supporting a depending dip tube to permit dispensing in an upright position upon actuation of the piston, a closure cap having an upstanding annular wall coupled to said cylinder for supporting the pump body within the interior of a container of liquid to be dispensed, said wall having an inner surface in contact with an outer surface of said cylinder, means defining a vent path extending between the interior of said closure cap and the ambient, and vent valve means acting between said closure cap and said pump piston for sealing said vent path closed at the end of said upstroke movement of said piston and for opening said vent path during the piston upstroke and downstroke movements, said vent path means comprising a spiral vent groove of at least one complete turn formed in one of said inner and outer surfaces for restricting the free flow of liquid therethrough in one direction to avoid leakage while dispensing in the inverted position, and said spiral vent groove being sized so that while dispensing in the inverted position the rate of liquid discharge from the container is greater than the flow of air through said vent groove in an opposite direction which thereby creates a vacuum in the container and effects a suck-back of air through said vent path means into the container for venting.

2. The pump according to claim 1, wherein said closure cap further has a central domed portion connected to said annular wall, and a collar depending from said domed portion and defining a central opening through which said piston stem extends.

3. The pump according to claim 2, wherein said vent valve means comprises an enlarged annular section formed on said piston stem in sealing engagement with said collar for sealing said vent path closed at the end of said upstroke movement, said collar disengaging said enlarged section for opening said vent path during the piston upstroke and downstroke movements.

4. The pump according to claim 2, wherein said closure cap is coupled to said cylinder by the provision of an enlarged outer diameter section on an upper end of said cylinder received in an annular groove provided in said annular wall of said closure cap.

5. The pump according to claim 4, wherein said spiral vent groove is located in said inner surface of said annular wall of said closure cap, said vent path means further comprising an annular gap formed between said enlarged outer diameter section and said annular groove, said vent groove terminating in said gap.

6. The pump according to claim 5, wherein said vent path means further comprises a vertical slot located in said enlarged diameter section extending between said annular gap and an upper edge of said cylinder, said upper edge being spaced from said domed portion.

* * * * *